US006491184B2

(12) United States Patent
Prieto

(10) Patent No.: US 6,491,184 B2
(45) **Date of Patent: *Dec. 10, 2002**

(54) CONTAINER EQUIPPED WITH A DEVICE FOR AUTOMATICALLY EXTRACTING A STRAW AND METHOD FOR AUTOMATICALLY EXTRACTING A STRAW

(76) Inventor: Dany Prieto, F-74210, Chevaline (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,290

(22) Filed: Jun. 22, 2001

(65) Prior Publication Data

US 2001/0035419 A1 Nov. 1, 2001

Related U.S. Application Data

(62) Division of application No. 09/581,503, filed as application No. PCT/FR98/02748 on Dec. 16, 1998.

(30) Foreign Application Priority Data

Dec. 18, 1997 (FR) ..... 97 16421

(51) Int. Cl.[7] ..... B65D 47/06
(52) U.S. Cl. ..... 220/709; 710/707; 710/708
(58) Field of Search ..... 220/707, 708, 220/710, 709; 215/388

(56) References Cited

U.S. PATENT DOCUMENTS

| | | | | |
|---|---|---|---|---|
| 2,450,244 A | * | 9/1948 | Lynch | 220/707 |
| 3,295,715 A | | 1/1967 | Pugh | |
| 3,717,476 A | * | 2/1973 | Harvey | 220/708 |
| 3,946,895 A | * | 3/1976 | Pugh | 220/707 |
| 4,537,324 A | * | 8/1985 | Wang | 220/707 |
| 4,582,213 A | * | 4/1986 | Park et al. | 220/707 |
| 4,690,294 A | * | 9/1987 | Jones | 220/707 |
| 4,792,083 A | | 12/1988 | Yassur | |
| 4,948,008 A | * | 8/1990 | Wu et al. | 220/707 |
| 5,054,639 A | | 10/1991 | Ahn | |
| 5,172,827 A | * | 12/1992 | Chang et al. | 220/707 |
| 5,848,721 A | | 12/1998 | Cornell et al. | |

FOREIGN PATENT DOCUMENTS

| | | |
|---|---|---|
| WO | 89/01750 | 3/1989 |

* cited by examiner

*Primary Examiner*—Joseph M. Moy
(74) *Attorney, Agent, or Firm*—Greenblum & Bernstein, P.L.C.

(57) ABSTRACT

A container having an interior, a device for opening the container, the device for opening having an orifice, a straw arranged in the interior of the container, the straw having a first end, a device and method for automatically extracting the straw from the interior of the container. The device for automatically extracting includes a straw supporting element movable between a free position in which the first end of the straw is located in the orifice of the device for opening the container and a locked position in which the first end is arranged in the interior of the container.

31 Claims, 13 Drawing Sheets

CONTAINER EQUIPPED WITH A DEVICE FOR AUTOMATICALLY EXTRACTING A STRAW AND METHOD FOR AUTOMATICALLY EXTRACTING A STRAW

CROSS-REFERENCE TO RELATED APPLICATIONS

The present application is a divisional application of U.S. application Ser. No. 09/581,503, filed Jul. 6, 2000, which is a U.S. National Stage under 35 U.S.C. 371 of PCT/FR98/02748, filed Dec. 16, 1998, not published under PCT Article 21(2) in English, the disclosures of which are expressly incorporated by reference herein in their entirety. The present application also claims priority under 35 U.S.C. §119 of French Patent Application No. 97 16421 filed on Dec. 18, 1997, the disclosure of which is hereby expressly incorporated by reference thereto in its entirety.

BACKGROUND OF THE INVENTION

1. Field of the Invention

The present invention relates to a container equipped with a device enabling a beverage to be absorbed in a hygienic manner preventing the consumer from placing his lips on an eternal portion of the container, and more particularly to the device for extracting a straw from the container.

2. Discussion of Background Information

Numerous containers are commercially available; plastic bottles, glass bottles, metallic cans, cardboard packagings, which can have various shapes allowing for the packaging of any type of liquid food products.

These various containers have the disadvantage, for the user, of being either unhealthy when one wishes to drink straight from the container, or impractical depending on the shape and size of the neck, or the very shape of the container itself.

In the particular case of metallic cans and cardboard packagings used for diverse and varied beverages, such as beers, sodas, fruit juices, or milk, they are very unhealthy. Indeed, from the locations where they are produced, after the beverage has been packaged, they are transported and unloaded without any specific hygienic measure, and then sold to the consumer by a retailer who stores them without any particular hygienic precaution and handles them manually. During these various manipulations, various microbes, viruses, bacteria or dust can be deposited on the walls of the container, which are ingested by the consumer when he places his lips on the container.

Furthermore, in the particular case of metallic cans, and independently of hygiene related problems, the consumer can be hindered when drinking the beverage by problems of ill-timed flow, which most often leaves stains on his clothes.

SUMMARY OF THE INVENTION

In order to avoid these disadvantages, the invention proposes to resolve these practical and hygiene related problems by simple and inexpensive measures, by way of a device for automatically extracting a straw located within the container.

Thus, according to its main characteristic, the device for automatically extracting a straw arranged within a container, such as a cylindrical can provided with an opening device, for example, is characterized in that it comprises:

a straw-supporting element mobile between a free position in which the straw which it supports has its end in the orifice of the container opening device and a locked position in which the end is arranged within the container, the straw-support being constituted of an arm bearing at its end, a mechanism for retaining the straw and being furthermore articulated on a piece, whereas the intermediate piece has a peripheral edge arranged between the upper wall of the can and its peripheral wall in order to be gripped therein by crimping.

According to an additional characteristic, the device has a mechanism for biasing the straw-supporting element that is adapted to bias the latter from its locked position to its free position.

According to additional characteristics, the device has a locking mechanism adapted to lock the straw-supporting element in its locked position, and an unlocking mechanism adapted to release the supporting element from its locked position.

According to the preferred embodiment of the invention, it is noted that the unlocking mechanism is constituted by a secondary unlocking arm, whereas the intermediate piece and the supporting arm are obtained all in one piece, forming a single and same plastic piece that has a certain elasticity.

According to another characteristic, the intermediate piece is in the form of an annular ring.

According to a complementary characteristic, the device for automatically extracting a straw according to the invention is characterized in that the actuation of the container opening device controls the actuation of the releasing device which release the straw-supporting element.

According to another characteristic, the straw-supporting element comprises a supporting arm provided with straw-retaining device at its end, the arm being articulated between its free position and its locked position on an independent intermediate piece affixed to the container.

According to the preferred embodiment of the device for automatically extracting a straw according to the invention, the biasing device for stressing the straw are constituted by the articulation of the straw-supporting arm on the independent intermediate piece and/or by the arm itself, and are obtained due to the flexibility and elasticity of the material used to make the arm, the piece, and the articulation which connects them.

According to an embodiment of the device for automatically extracting a straw, the locking device comprises a secondary locking arm which has, at its end, an assembly of abutment surfaces adapted to cooperate with complementary support surfaces carried by the straw-supporting element when the latter is in the locked position.

According to this embodiment, the releasing device comprises a releasing lug carried by the secondary locking device and adapted to cooperate with the container opening device to cause the displacement of the secondary arm toward an extreme release position in which its abutment surfaces no longer cooperate with the complementary support surfaces of the straw-supporting element.

According to a complementary characteristic of the device for automatic extraction according to the invention, the straw-supporting element, the biasing device, the locking and releasing device comprise a single piece called the independent intermediate piece.

According to the preferred embodiment of the device for automatically extracting a straw according to the invention, the independent intermediate piece is in the form of an annular ring adapted to be arranged beneath the upper wall or cover of a container in the form of a cylindrical can.

According to this embodiment, the intermediate piece comprises a sealing device adapted to make it possible to obtain sealing between the cover and the peripheral wall of the can, the sealing device being adapted to be implemented during assembly.

According to the invention, the device for automatically extracting a straw from a container comprises a straw-supporting element movable between a free position and a locked position, the straw-supporting element comprising an arm bearing at its end a mechanism for retaining the straw and being articulated on an intermediate piece, the intermediate piece having a peripheral edge arranged between an upper wall of a container and its peripheral wall in order to be gripped therein by crimping. The device further comprises a mechanism for biasing the straw-supporting element from its locked position to its free position. Additionally, the device comprises a mechanism for locking the straw-supporting element in its locked position. Furthermore, the device comprises a device for unlocking the supporting element from its locked position. The unlocking device may comprise a secondary unlocking arm. The intermediate piece and the supporting arm may comprise a single plastic piece that has a certain elasticity. The intermediate piece may be in the form of an annular ring.

A further aspect of the invention resides in having in combination, a container having an interior, a device for opening the container, the device for opening having an orifice, a straw arranged in the interior of the container, the straw having a first end, and a device for automatically extracting the straw from the interior of the container, the device for automatically extracting comprising a straw-supporting element movable between a free position in which the straw first end is in the orifice and a locked position in which the first end is arranged in the interior of the container, the straw-supporting element comprising an arm bearing at its end a mechanism for retaining the straw and being furthermore articulated on an intermediate piece, wherein the intermediate piece has a peripheral edge arranged between an upper wall of the container and its peripheral wall in order to be gripped therein by crimping. The combination may further comprise a mechanism for biasing the straw-supporting element from its locked position to its free position. Furthermore, the combination may comprise a mechanism for locking the straw-supporting element in its locked position. Moreover, the combination may comprise a device for unlocking the supporting element from its locked position. The unlocking device may comprise a secondary unlocking arm. The intermediate piece and the supporting arm may comprise a single plastic element having a certain elasticity. The intermediate piece may be in the form of an annular ring.

Yet another aspect of the invention resides in a method of automatically extracting a straw from an interior of a container having an interior and including a device for opening the container, the device for opening having an orifice, a straw arranged in the interior of the container, the straw having a first end, and a device for automatically extracting the straw from the interior of the container. The method comprises moving a straw-supporting element between a free position in which a first end of the straw is in the orifice and a locked position in which the first end is arranged in the interior of the container, the straw-supporting element comprising an arm bearing at its end a mechanism for retaining the straw and being furthermore articulated on an intermediate piece, and crimping a peripheral edge of the intermediate piece peripheral edge between an upper wall of the container and its peripheral wall in order to be gripped therein. The method may further comprise biasing the straw-supporting element from its locked position to its free position. Furthermore, the method may comprise locking the straw-supporting element in its locked position. Moreover, the method may comprise unlocking the supporting element from its locked position.

Furthermore, the invention also relates to a container for beverage, of the type comprising a device for automatically extracting a straw, such as those described hereinafter.

Other characteristics and advantages of the invention will become apparent from the description that follows, with reference to the annexed drawings which are only provided by way of non-limiting examples.

BRIEF DESCRIPTION OF THE DRAWINGS

FIGS. 1–14 show the preferred embodiment of the device for extracting the straw, as well as alternative embodiments of the device.

FIGS. 1 and 2 respectively show in perspective the opening of a container such as a metallic cylindrical can.

FIG. 3*a* shows the device in the locked position.

FIG. 3*b* shows the extraction device in the release position, when it is getting ready to be unlocked.

FIG. 3*c* shows the device when the supporting element passes from its locked position toward its free position.

FIG. 3*d* shows the extraction device in the free position.

FIG. 4 is a perspective bottom view showing the preferred embodiment of the extraction device in the free position.

FIG. 10 schematically shows a transverse cross-section of the extraction device and its container in the free position, a portion of the straw being extracted from the container.

FIG. 11 is a perspective view of an alternative embodiment of the extraction device.

FIG. 12 is a perspective view of an alternative embodiment of the extraction device.

FIG. 13 shows this alternative embodiment according to another perspective view.

FIG. 14 shows this alternative embodiment according to a transverse cross-sectional view.

DETAILED DESCRIPTION OF THE PRESENT INVENTION

It is noted that to allow for a better understanding of the various Figures, the straw is not shown in FIGS. 4, 5*b*, 6*b*, 7*a*, 8, and 10; only the device for retaining the straw-supporting element is shown.

Figure 1:
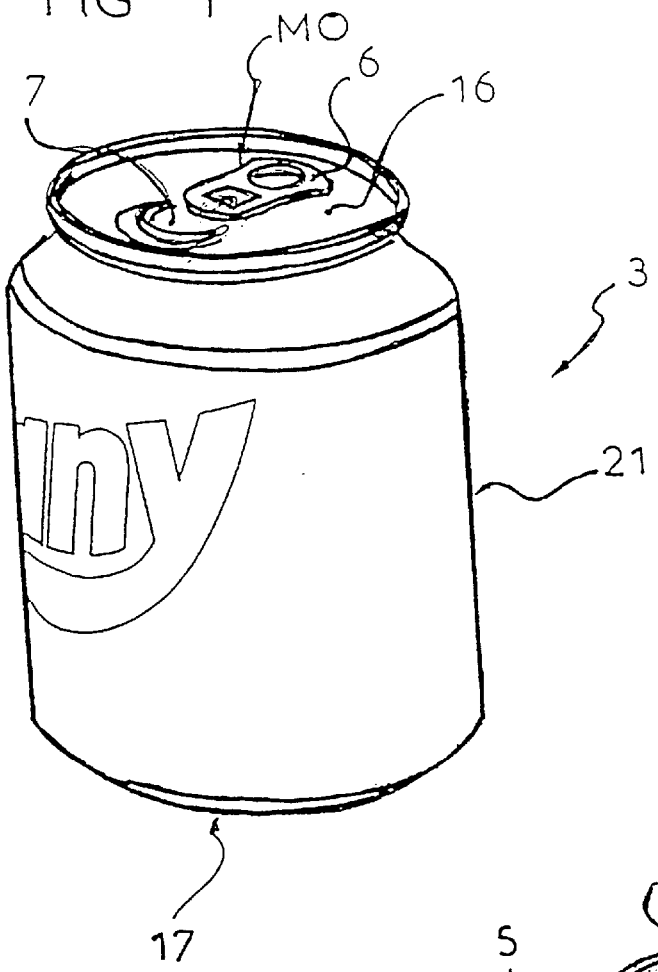
Figure 2:
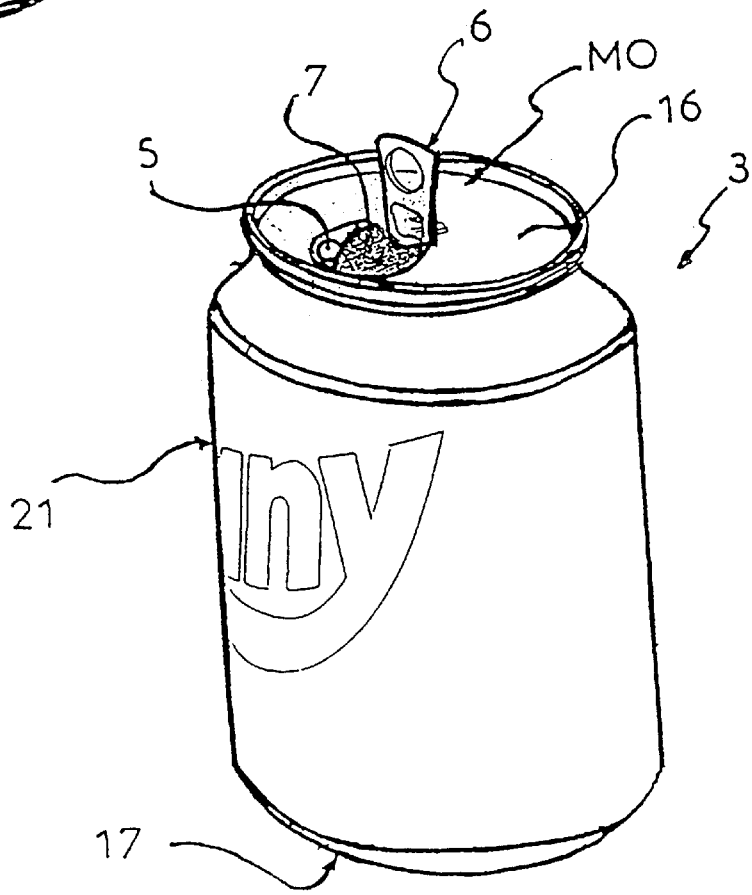

The invention relates to a device for automatic extraction generally designated by the reference numeral (1) adapted to automatically extract, when it is being opened, a straw (2) arranged within a container (3). The extraction device (1) is advantageously described in the particular case of metallic cylindrical cans whose opening device (MO) comprises, in a manner known in itself, of a push ring (6) and a precut tongue (7) which can pivot toward the inside of the container (3) under the effect of the ring to free the orifice (5) of the opening device, as shown in FIGS. 1 and 2. It is understood that the device for automatic extraction according to the invention could be modified to be adapted to other types of containers or other types of opening devices without leaving the scope of protection of the invention.

According to the invention, the device (1) for automatically extracting the straw (2) comprises a straw-supporting element (4) that is movable between a locked position (B), in which the straw (2) is located within the container (3) and which corresponds to the closed position of the opening device (MO), and a free position (A), in which the supporting element (4) presents the end (2*a*) of the straw (2) at the level of the orifice (5), and which corresponds to the open position of the opening device. The device also comprises a biasing device (MS) for stressing the straw-supporting element (4) which tend to cause it to displace from its locked position (B) toward its free position (A). Furthermore, a locking device (MV) adapted to lock the straw-supporting element (4) in its locked position (B) and a releasing device (MDV) adapted to cause the release of the element are provided. Moreover, the releasing device (MDV) is preferably actuated by the opening device (MO) of the container (3) when the consumer opens the orifice (5).

According to the preferred embodiment of the extraction device according to the invention, the straw-supporting element is constituted by an arm (4) carrying, at its end (4*a*), a mechanism for retaining the straw (2) such as a tube portion (10) within which the end (2*a*) of the straw is arranged. The straw-supporting arm (4) is advantageously articulated on an independent intermediate piece (9) arranged within the container and affixed thereto by way of a fixing device that will be described hereinafter.

Figure 4:
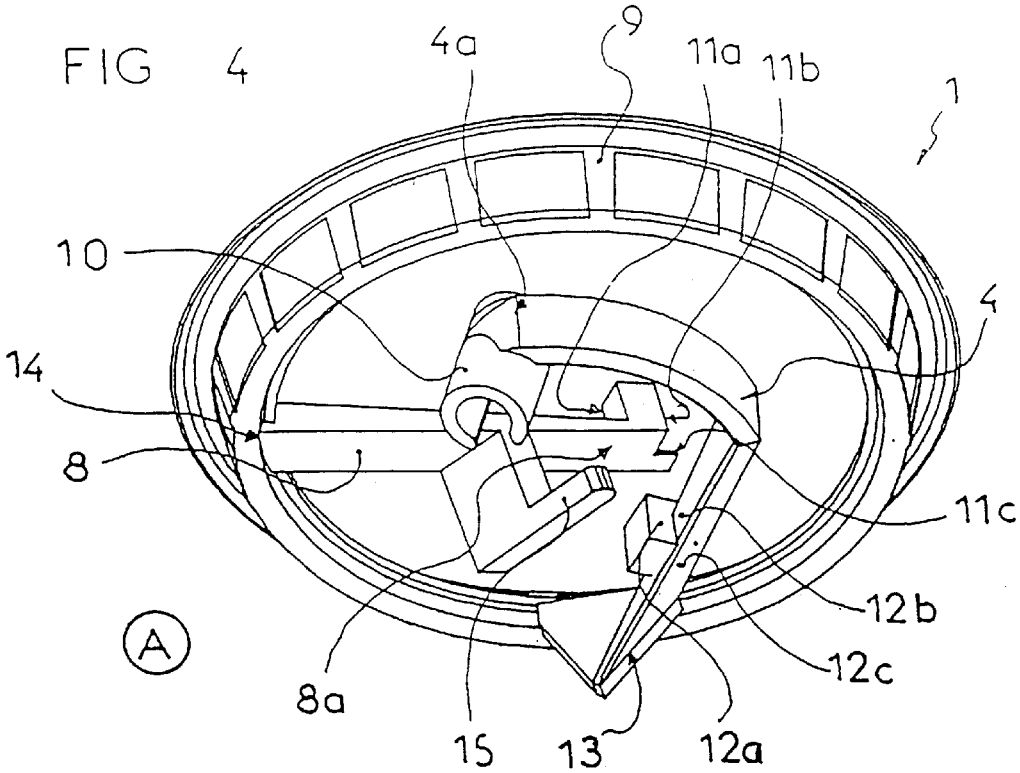

According to this preferred embodiment, the locking device (MV) shown in FIG. 4 comprises a locking element such as a secondary locking arm (8), for example, which has, at its end (8*a*), an assembly of abutment surfaces (11), namely, two lateral abutments (11*a*, 11*b*), and a lower abutment (11*c*). The lateral (11*a*, 11*b*) and lower (11*c*) abutment surfaces are adapted to cooperate with complementary support surfaces (12, 12*a*, 12*b*, 12*c*) carried by the straw-supporting arm (4) when the extraction device (1) is in the locked position (B). The secondary arm (8) is advantageously articulated at its other end on the independent intermediate piece (9); however, it is understood that it could very well be articulated on another piece affixed to the can (3).

Figure 5A:
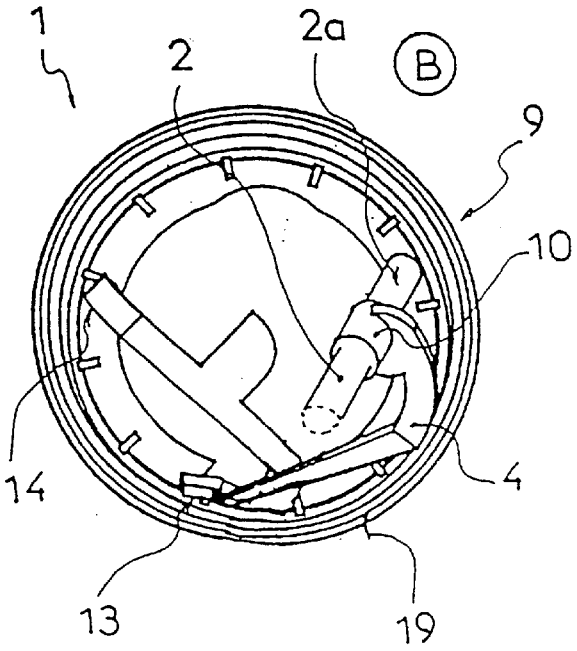
FIGS. 5*a* and 5*b* show bottom views of the extraction device in the locked position and free position, respectively, the configuration of the abutment and support surfaces of the various arms being simplified, as well as the releasing lug in order to facilitate the understanding of the Figures.
Figure 5B:
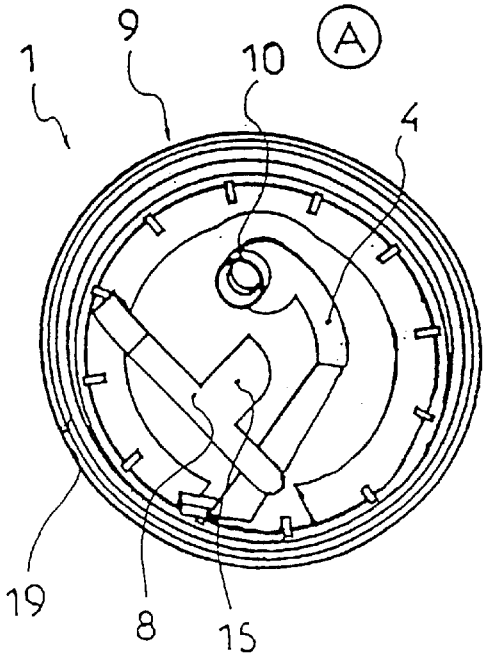
Figure 6A:
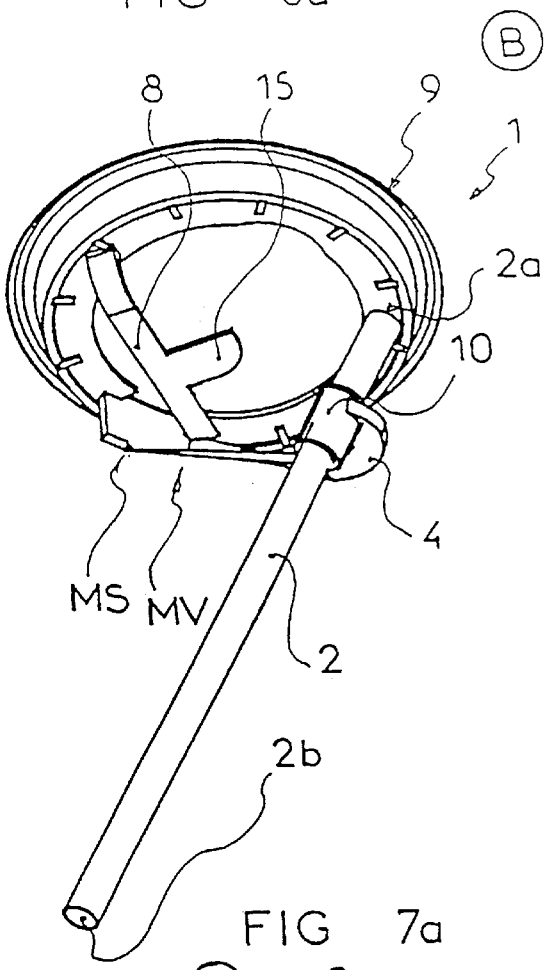
FIGS. 6*a* and 6*b* show in perspective views different from those of FIGS. 5*a* and 5*b*, the extraction device in its locked position and in its free position, respectively.
Figure 6B:
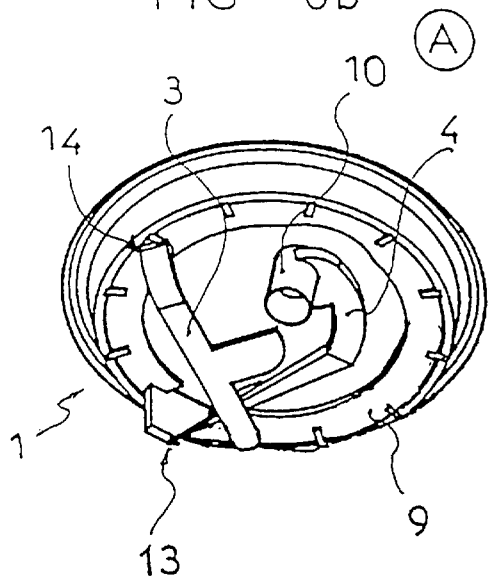

According to the preferred embodiment of the device (1) for automatically extracting the straw, the intermediate piece (9) is made out of a material that is slightly flexible and has a certain elasticity. Since the supporting arm (4) and secondary arm (8) are constituted by extensions of the intermediate piece (9), their articulation therewith occurs along a hinge (13, 14) formed, in a known manner, by a narrowing of the section of the extensions forming the arms, for example. The elasticity of the material used enables the articulated arms (4, 8) to be biased elastically toward their respective initial positions which each correspond to the free position of the extraction device (1), as shown in FIGS. 5*b* and 6*b*. The elasticity of the straw-supporting arm (4) constantly tends to bring it back to its free position (A) and thus constitutes the biasing device (MS) of the extraction device (1). However, the biasing effect could be obtained by any equivalent elastic return device, such as located, for example, on the hinges or articulations of the arms, without leaving the claimed scope of protection of the invention.

Figure 3A:
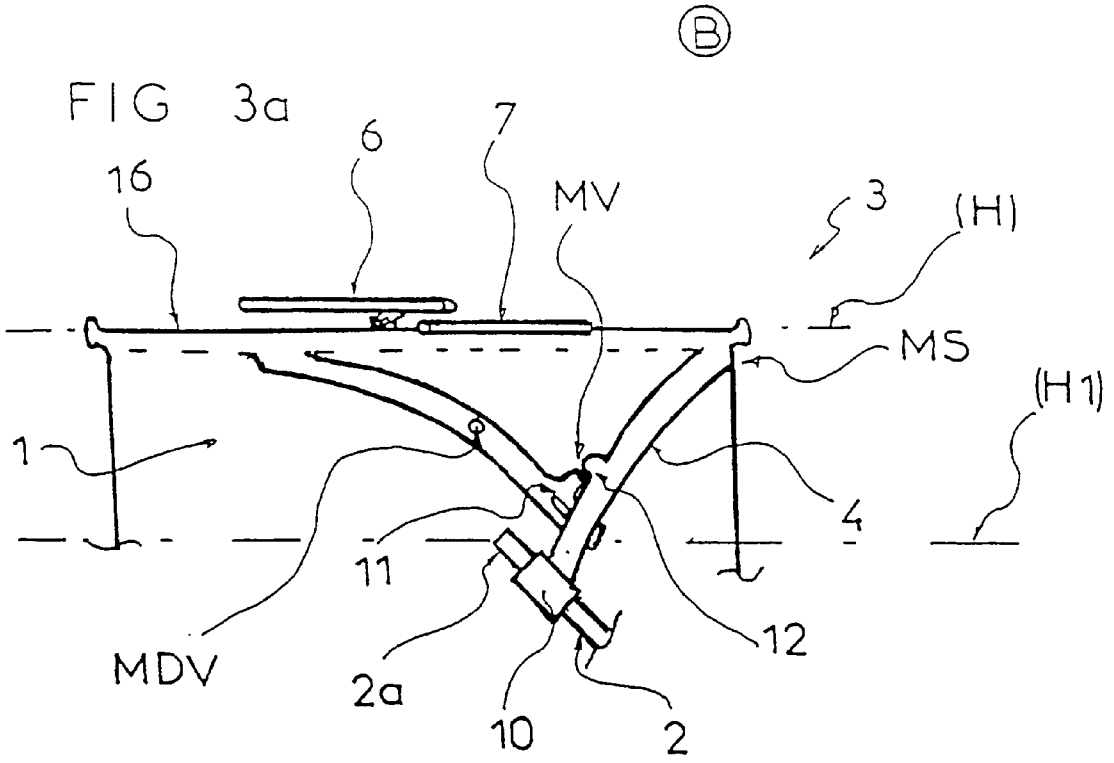
FIGS. 3*a*–3*d* constitute a schematic diagram of the extraction device and its functioning.

According to the preferred embodiment of the extraction device (1), the bias of the articulated arms (4, 8), due to the elasticity of their materials, when they are bent in the locked position (B), enables the respective abutment and support surfaces (11, 12) to cooperate against return forces that are exerted on the arms according to a known flying buttress principle shown schematically in FIG. 3*a*. Thus, the assembly of the support and abutment surfaces makes it possible to position and maintain the articulated arms, and essentially the straw-supporting arm (4) in a locked position (B), as shown in FIGS. 5*a* and 6*a*, in which the end (2*a*) of the straw (2), which it carries, is retracted within the can (3), and where the straw-supporting arm (4) is biased toward its free position (A) due to its elasticity and to its bent position.

Figure 7A:
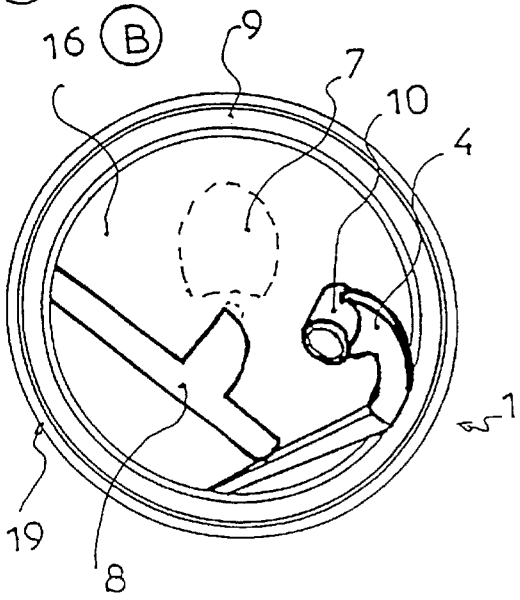
FIG. 7*a* shows a bottom view of the extraction device in the locked position.
Figure 7B:
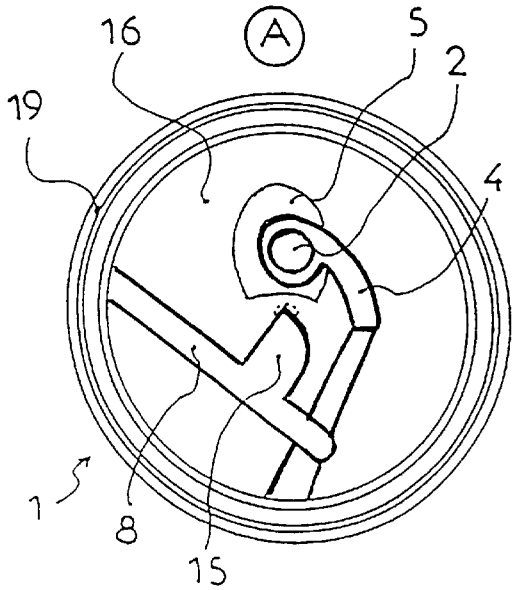
FIG. 7*b* shows the extraction device in the free position, in a view similar to FIG. 7*a*.

It is noted that, according to the preferred embodiment of the device, the articulation (13) of the supporting arm (4) passes from its locked position (B) in which the end (2*a*) of the straw (2) is located in a horizontal plane (H1) located beneath the horizontal plane (H) comprising the orifice (5) and offset with respect to this orifice, as shown in FIGS. 3*a* and 7*a*, toward a free position (A) in which the end (2*a*) is arranged in a plane (H2) located slightly above the plane (H) of the orifice, plumb therewith, as shown in FIGS. 3*d*, 7*b*, 8*b* and 10. The displacement of the supporting arm (4) thus occurs by pivoting in an inclined plane orthogonal with respect to the axis of its articulation (14) so as to allow for the passage of the end (2*a*) of the straw (2) in the orifice (5).

Figure 3B:
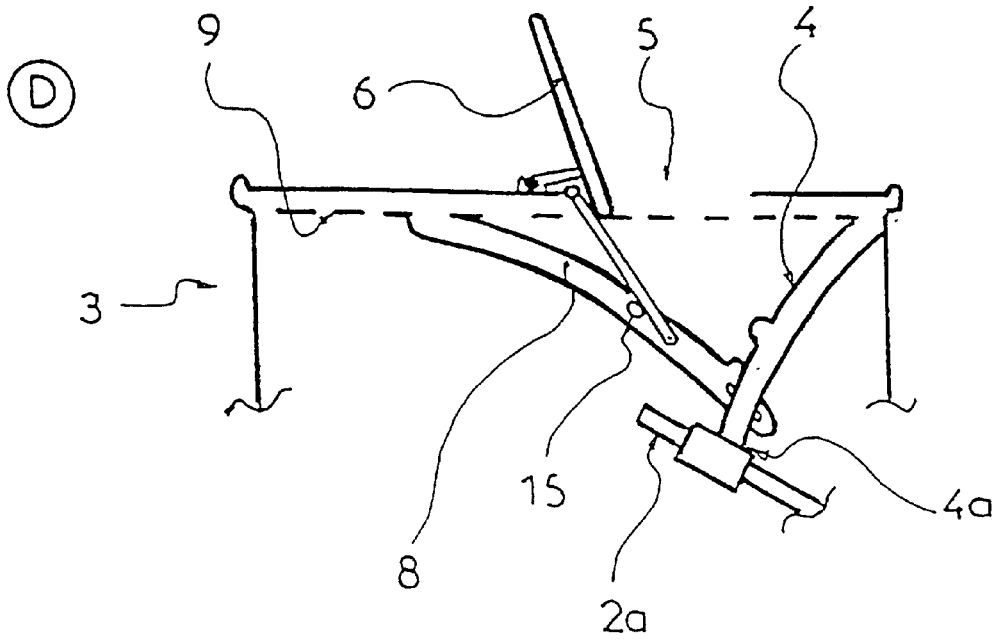
Figure 3C:
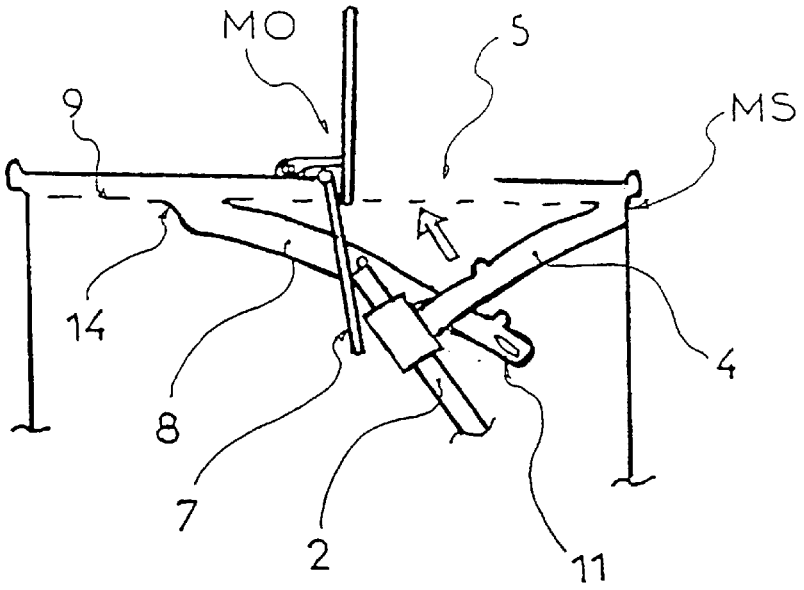
Figure 3D:
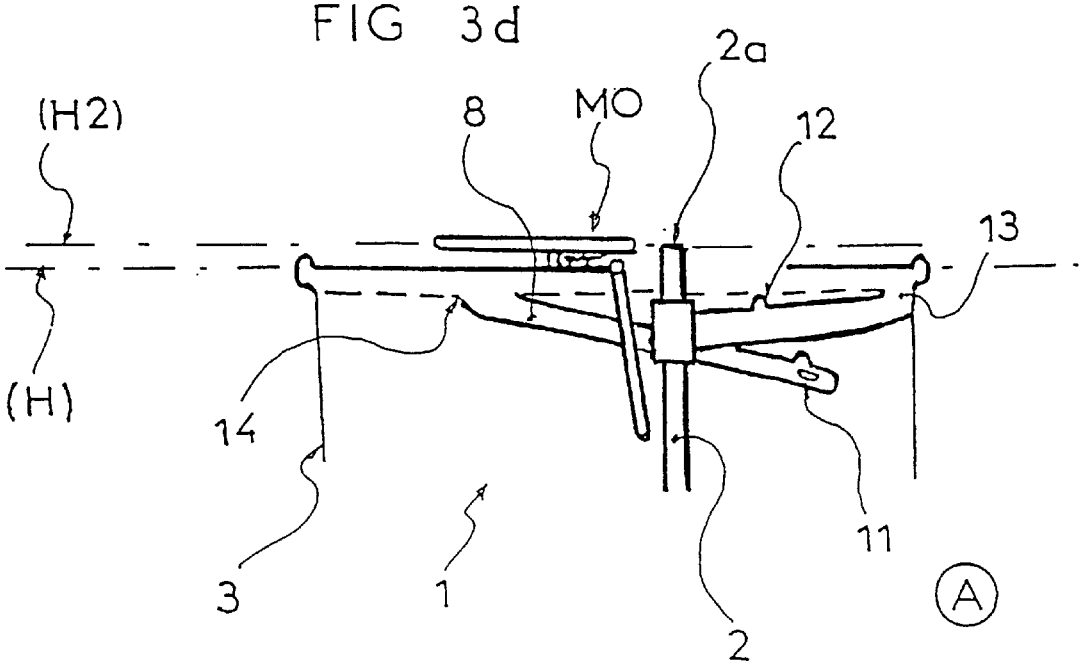

The extraction device (1) also comprises releasing device (MDV) which make it possible, when the opening device (MO) of the container (3) shown schematically in FIG. 3*b* are actuated, to release the supporting arm (4) from its locked position (B). According to the preferred embodiment, the releasing device comprises a releasing lug (15) arranged on the secondary locking arm (8) and adapted to be actuated during the opening of the container by the pivoting, toward the inside of the can (3), of the precut tongue (7) or lid of the opening device so as to cause the displacement, by pivoting about its articulation (14), of the secondary arm toward an extreme releasing position (D) shown schematically in FIG. 3*b*. The pivoting of the secondary arm toward its releasing position (D) makes it possible to release the assembly of complementary abutment and support surfaces (11*a*, 11*b*, 11*c*, 12*a*, 12*b*, 12*c*) which cooperated with one another in the locked position (B), such that the straw-supporting arm (4) is returned toward its free position (A) by the biasing device (MS), as shown in FIG. 3*c*, the releasing lug then ceasing to cooperate with the precut tongue so as to also free the secondary arm.

Furthermore, according to the preferred embodiment, the secondary unlocking arm (8) is also biased toward its free position (A) by a complementary biasing device also obtained by the elasticity of the material used to make it, or by an elastic return device located on the articulation (14) of the arm on the intermediate piece (9). During the releasing phase, the secondary arm (8) passes above the supporting arm (4) to release the support and abutment surfaces of the two articulated arms which cooperate. Then, the two arms are each subject to a return force from their respective biasing device and come to position themselves in the free position. It is noted that the secondary unlocking arm (8) overlaps the supporting arm (4) to pass beneath and thus make it possible, due to its specific return force, to also bias the supporting arm (4) toward the top (HA) in a manner so as to bring it toward its free position (A).

Figure 8A:
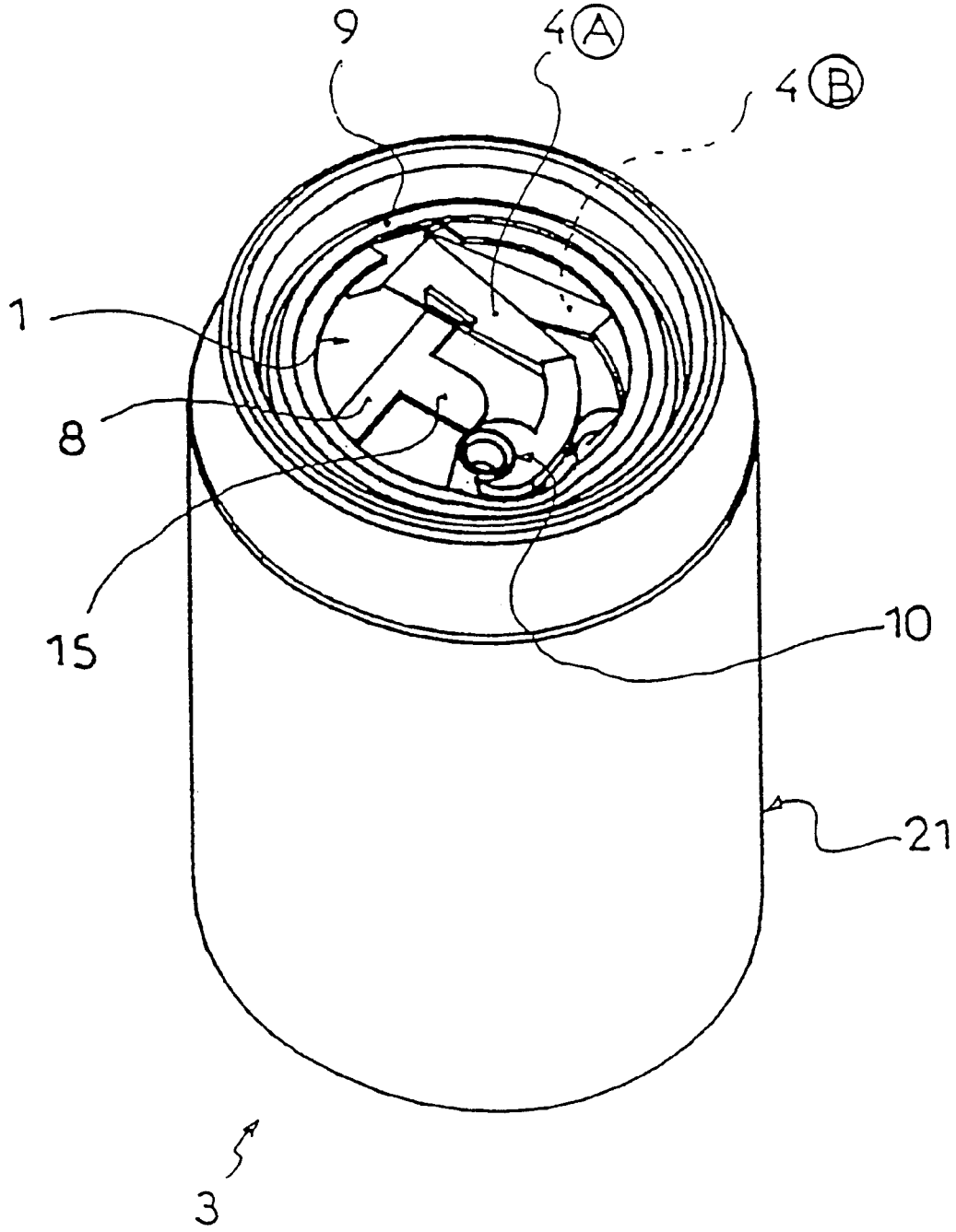
FIG. 8*a* shows in perspective the extraction device arranged in its cylindrical can and shows the two extreme positions of the straw-supporting arm; the upper wall of the can is not shown.
Figure 8B:
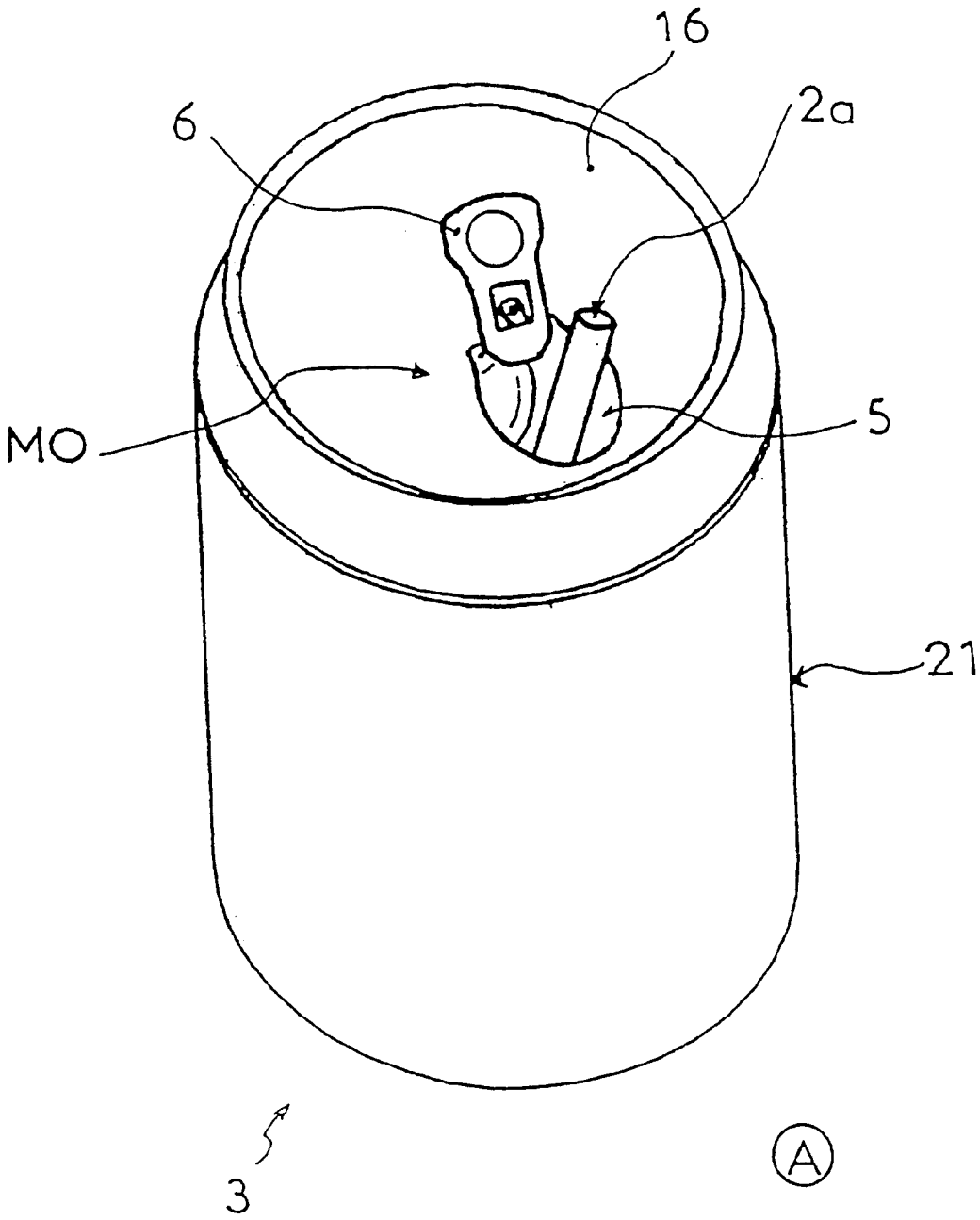
FIG. 8*b* shows in perspective the can and the end of the straw as extracted therefrom when the extraction device is in the free position.

It is noted that the articulated arms (4, 8), the device for retaining the straw (2), the supporting arm (4), the support and abutment surfaces, the secondary arm (8), and the intermediate piece (9) are advantageously made integral and form a single piece which is in the form of an annular ring (9) adapted to be arranged in the interior (INT) of the can (3), beneath the upper wall (16) on which the opening device of the can is arranged, as shown in FIG. 8*a*.

According to the preferred embodiment of the invention, the annular ring (9) is made of a plastic material of the type used in the food industry, so that it can be placed in contact with the liquid intended to be consumed. It can be advantageously obtained by an injection process, or by any other equivalent method.

Figure 10:
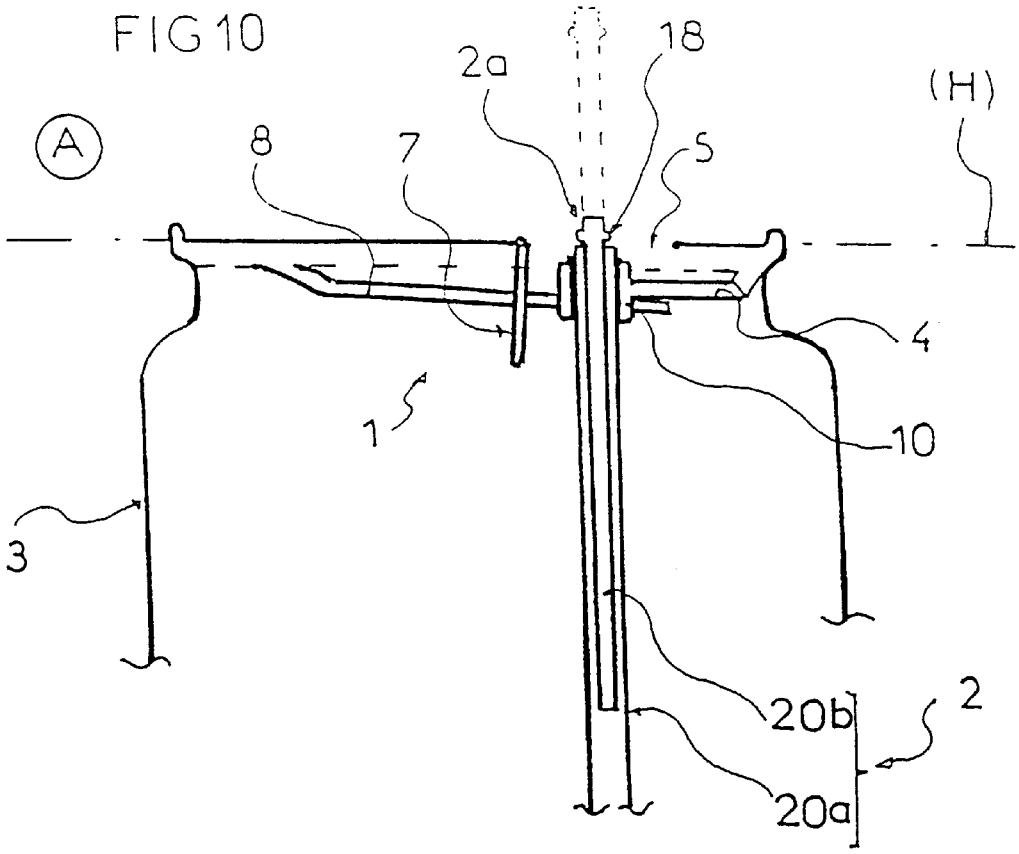

It is also noted that the straw (2) can comprise two coaxial straw portions (20*a*, 20*b*), one (20*a*) of which is retained by the retention device (10) of the straw-supporting arm (4), and the other (20*b*) of which slides within the first straw (20*a*), as shown in FIG. 10, and thus enables the user to extract a portion thereof to drink while maintaining the lower end (2*b*) of the straw portion (20*a*) at the bottom (17) of the container (3) to enable the entire content thereof to be drawn up. The upper straw portion (20*b*) can advantageously comprise a retaining annular flange (18) adapted to prevent the latter from sliding entirely in the lower portion (20*a*). The flange (18) is located on the straw portion (20*b*) such that its upper end (2*a*) is located slightly above the plane (H) of the orifice (5) when the extraction device (1) is in the free position (A).

Figure 9A:
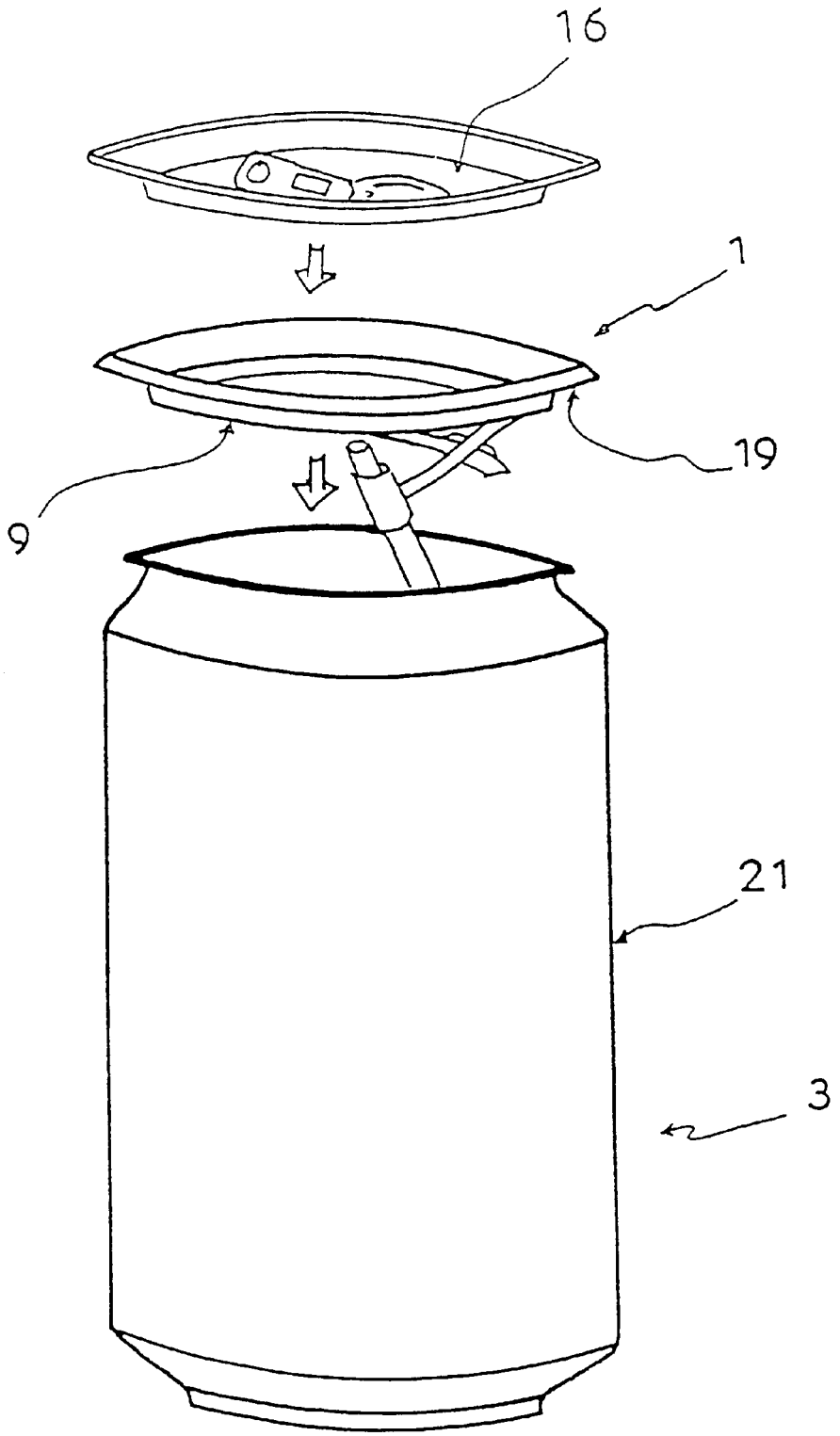
FIG. 9*a* schematically shows a transverse cross-section of the positioning of the straw extracting device within the can.

It is important to note that the annular ring (9) can advantageously comprise a sealing device constituted by its peripheral edge (19). Thus, during the packaging of the can (3) with its extraction device (1) shown in FIGS. 9*a* and 9*b*, the peripheral edge (19) can advantageously replace the silicone joints used by manufacturers to ensure imperviousness between the peripheral wall (21) of the can and its upper wall (16), the edge being pinched between the two walls when the latter are assembled to one another by crimping, for example, as shown in detail in FIG. 9*c*. Thus, according to the various embodiments, the extraction device comprises an independent piece (9) that can be arranged and fixed in the container, and in particular in a can, without requiring any structural modification thereof.

Figures 9B, 9C:
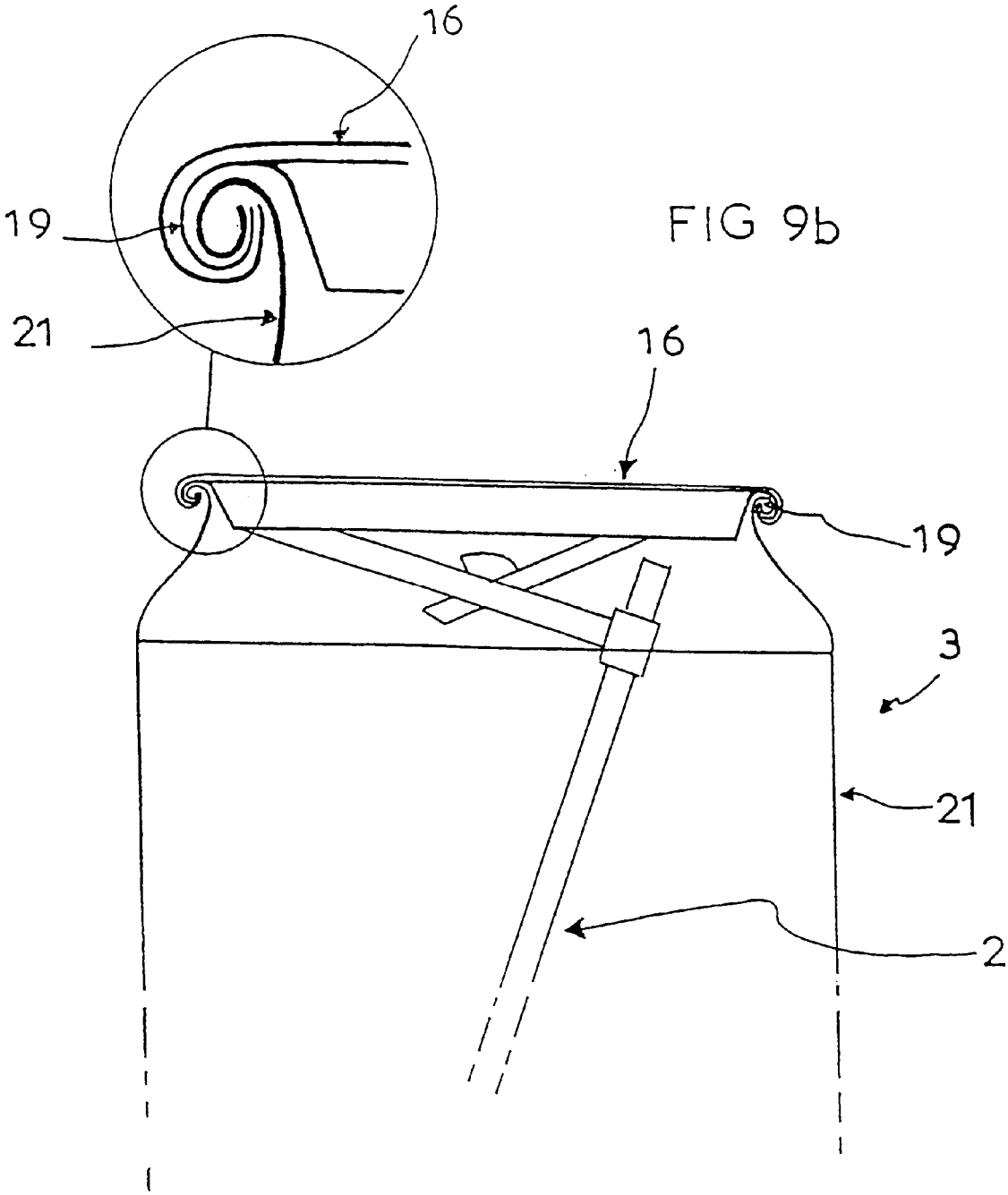
FIG. 9*b* shows the extraction device arranged in its can, according to a view similar to FIG. 9*a*.
FIG. 9*c* is a detail of FIG. 9*b* showing the sealing device of the extraction device.

Furthermore, according to the various embodiments of the extraction device, the annular ring (9) can advantageously be obtained by an injection process of the dual-material type, so as to obtain a piece made of a first relatively rigid plastic material provided with a peripheral edge (19) made of a second, more flexible plastic material injected simultaneously in a known manner. Thus, during the positioning of the device in the can, the relatively flexible peripheral edge makes it possible to obtain a perfect sealing between the upper wall (16) and the peripheral wall (21) of the can (3) as shown in FIG. 9*c*, whereas the relative rigidity of the main central piece enables the optimum functioning of the device, and especially the elastic bias of the arms from their locked position (B), in which they are in a slightly bent position, toward their free position (A).

Figure 11:
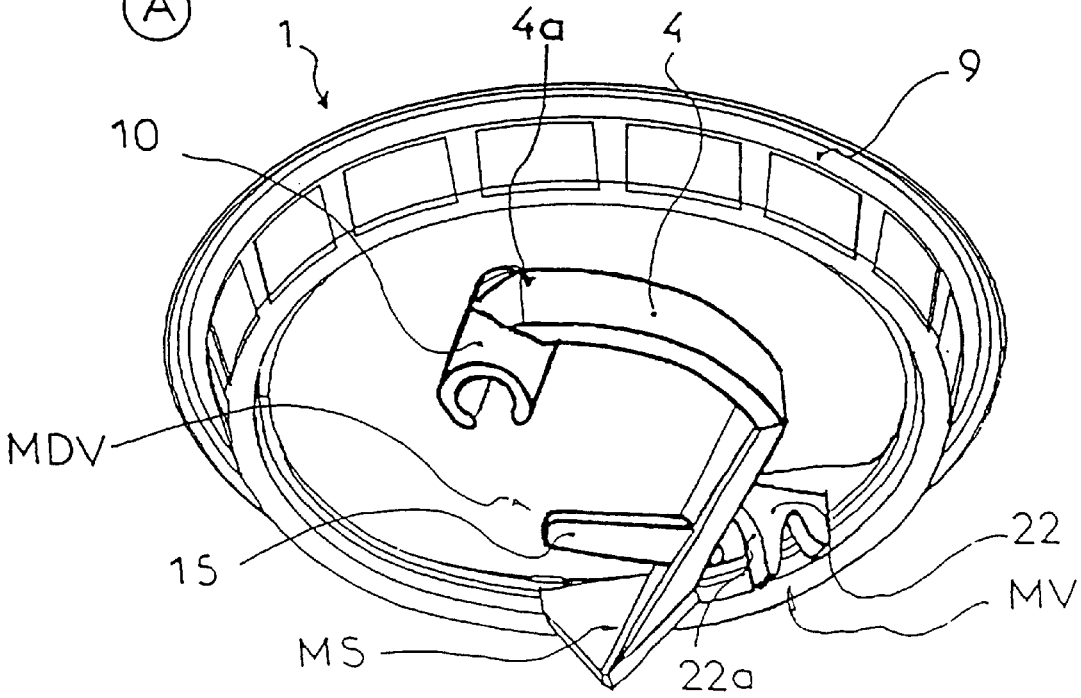

According to a second embodiment shown schematically in FIG. 11, the extraction device (1) comprises a straw-supporting arm (4) of the type described in the preceding embodiment, articulated and biased toward its free position (A). However, the locking device (MV) is no longer constituted by a secondary arm, but by an abutment system (22) in the form of a catch affixed to the intermediate piece (9) on which the supporting arm (4) can be arranged in the locked position (B), the arm being biased by its biasing device (MS) toward its free position (A).

According to this embodiment, the releasing device (MDV) comprises a releasing lug (23) formed by a projecting wall portion of the straw-supporting arm (4). This lug (23) is adapted to cooperate with the precut tongue (7) of the can opening device (MO) when the latter pivots inwardly to release the supporting arm (4) of its abutment (22) against the bias of the biasing device (MS). When the arm (4) has come out of its catch and the releasing lug has stopped cooperating with the precut tongue (7), the biasing device returns the arm toward its free position.

It is noted that, according to this embodiment, the release of the arm (4) which occurs by way of the releasing lug (23) makes it possible to provide the arm with a potential energy greater than that which it has in the locked position, since the arm (4) is displaced against the return force of the biasing device (MS) by a height that is necessary to pass the catch; the abutment (22) thus makes it possible to provide the arm (4) with a complementary energizing so as to facilitate its positioning in the free position (A) when it frees itself from the abutment. It is noted that the lateral edge (22*a*) of the abutment (22) can advantageously be inclined and slightly incurved and, as a result, can constitute a mechanism for guiding the support arm (4), making it possible to guide it from its extreme releasing position in which it comes out of the catch toward its free position.

It is also important to note that, according to this embodiment, the supporting arm (4), when it is in the free position, is arranged in the same plane as the abutment (22) and is positioned next to the latter. In this way, during the injection process adapted to mass produce the circular ring (9) of the extraction device (1), the mold used is a simple mold, and is less expensive than in other slightly more complex embodiments which can require the use of so called slide molds.

Figure 12:
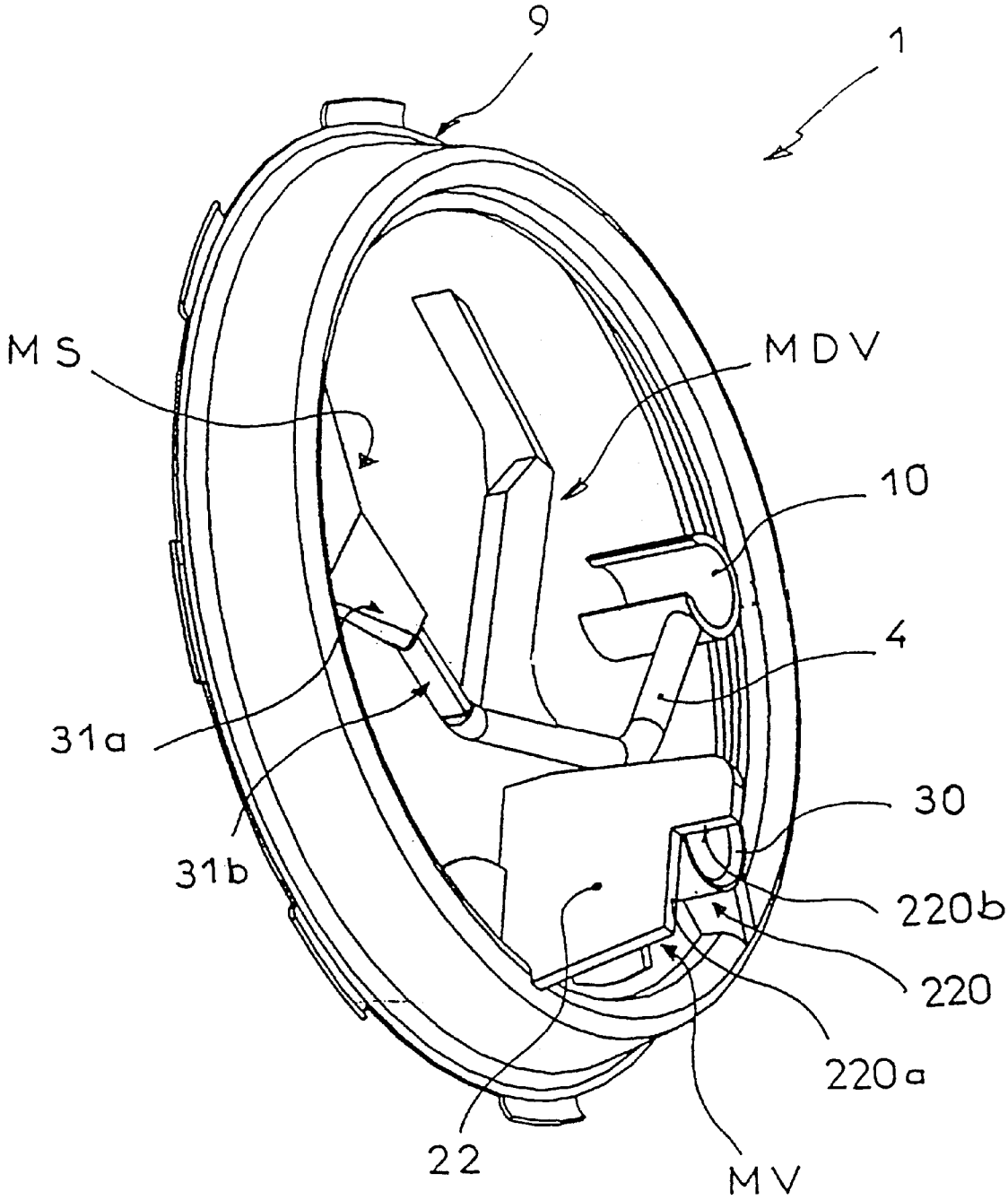
Figure 13:
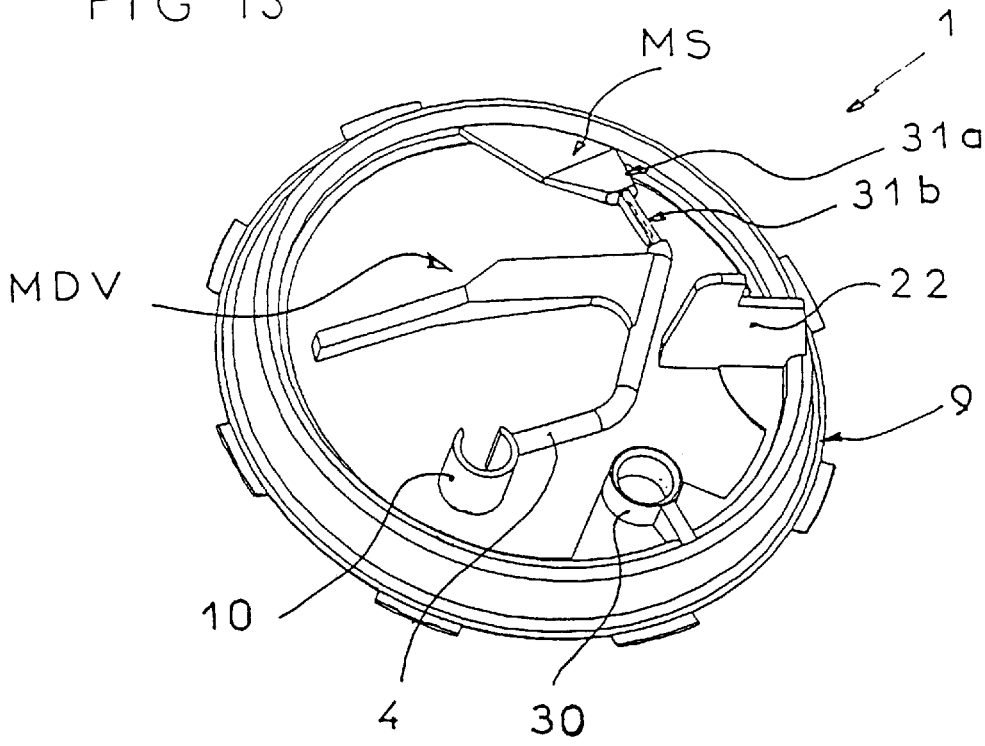
Figure 14:
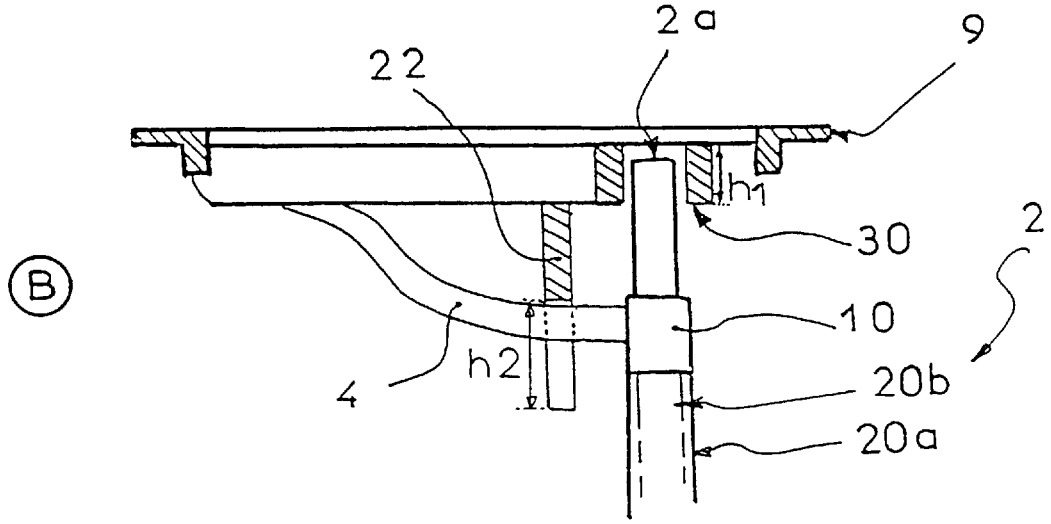

According to a third embodiment in which the locking device (MV) comprises an abutment (22), for example, the extraction device (1) can have a complementary immobilizing device adapted to enable the straw (2) to be immobilized within the can (3) when the supporting arm (4) is in the locked position (B). As a result, during the transportation and storage of the beverage cans (3), this immobilizing device reduce the biases on the supporting arm (4), and thus make it possible to avoid the ill-timed release thereof. Thus, as shown in FIGS. 12, 13, and 14, where the constituent elements of the extraction device (1) are designated by reference numerals that are similar to those used for equivalent elements in the previously described embodiments, the complementary immobilizing device of the straw (2) comprises a tube portion (30) open toward the bottom (BA) and located on the intermediate piece (9) in the axis of the straw (2) when the latter is in the locked position (B). As a result, the end (2*a*) of the straw (2), in this locked position (B), gets housed in the tube portion (30) so as to be immobilized therein. It is noted that the height (h1) of the end (2*a*) of the straw which is engaged in the tube portion (30) is lower than the height (h2) of the abutment along which the straw (2) and supporting arm (4) must travel to reach the releasing position, as shown in FIG. 14. Thus, during the actuation of the opening device (MO), the end (2*a*) of the straw exits the tube portion (3) before the arm reaches its releasing position.

According to this third embodiment, the supporting arm (4), or more specifically its articulation on the intermediate piece (9), has a stress distributing device adapted to avoid having a zone where the stresses and deformations are too substantial, and which could lead to the rupture or damage of the articulation. Thus, as shown in FIGS. 12 and 13, the supporting arm (4) has sectional profiles, in the vicinity of its base, which have parallel lateral flat portions. This configuration makes it possible to stiffen the arm (4) when it works in flexion and to distribute the stresses in the entire articulation which includes two arm portions (31*a*, 31*b*) each having elastically deformable lateral flat portions arranged orthogonally, as shown in FIGS. 12 and 13, to constitute this type of elastically deformable gimbal.

The abutment system (22) adapted to retain the supporting arm (4) in its prestressing armed position comprises a hooking catch (220) formed of a horizontal support (220*a*) and a vertical edge (220*b*).

According to the various embodiments described, the extraction device comprises a piece in the form of an annular ring; however, according to other embodiments not shown, the device can be obtained in a plurality of pieces. Moreover, the constituent piece(s) of the extraction device could have a different form than the form of the annular ring, and can have a sector shape or the like, for example. Furthermore, according to the preferred embodiment, the fixing device of the annular piece comprises the peripheral edge adapted to be crimped between the cover and the peripheral wall of the can, the edge also comprising the sealing device; however, it is understood that the fixing device could have a different configuration. Thus, the annular piece could, for example, not be provided with a peripheral edge, but could be fixed by wedging in the upper portion of the can which has a slightly truncated shape.

It is noted that the straw (2), comprising two straw portions, namely, an external portion (20*a*) in which an internal portion (20*b*) slides, is advantageously retained by the retaining device (10) by its internal portion (20*b*), whereas the upper end of the external portion (20*a*) is in support on the lower edge of the tube portion (10) comprising the retaining device, as is shown in FIG. 14. In addition, the tube portion (10) is advantageously split to provide it with the adequate elasticity to ensure proper holding of the straw.

Figure 15:
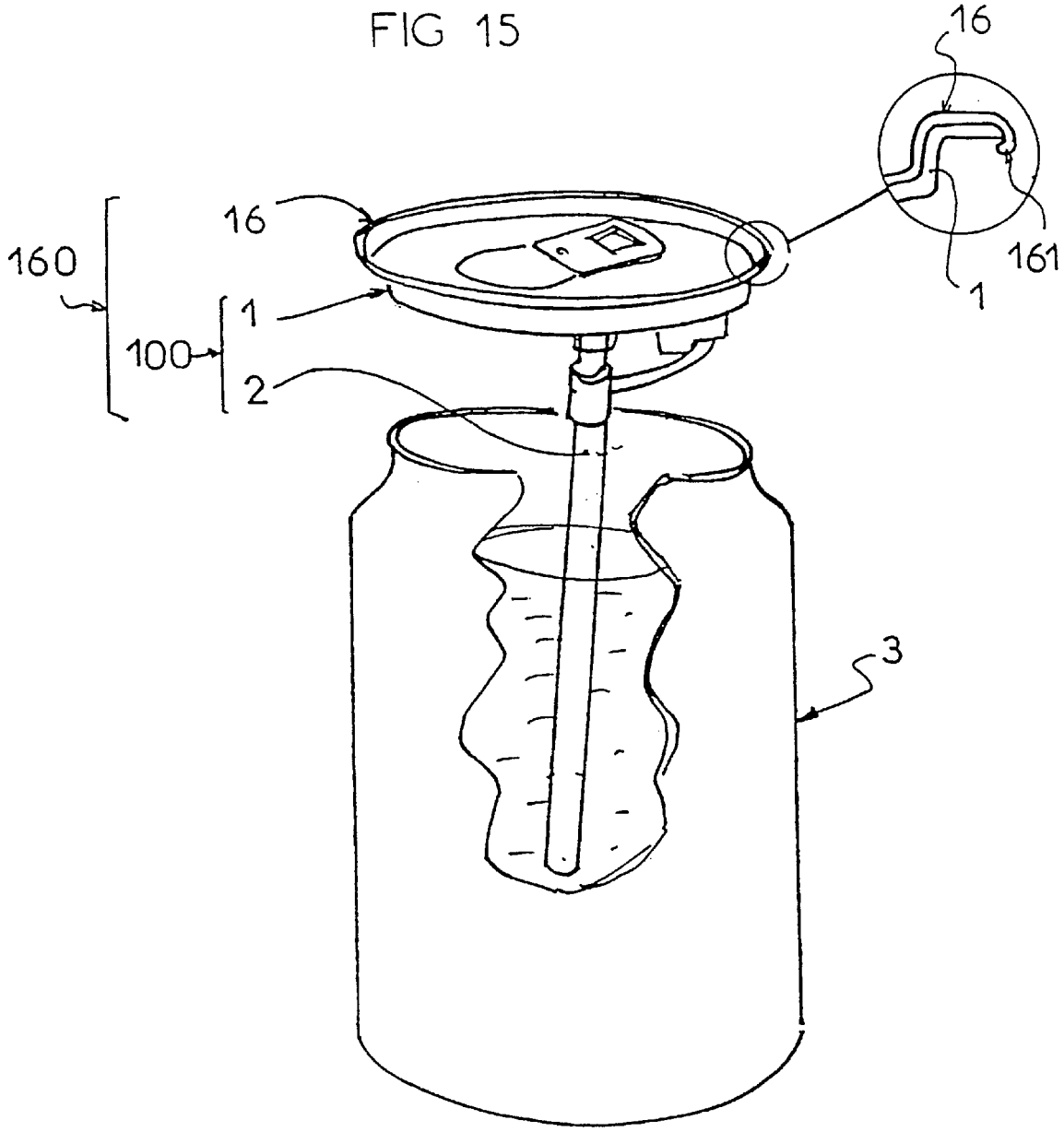
FIG. 15 is a diagram showing an improvement adapted to promote the assembly.

Furthermore, the extraction device (1) in the armed position with the straw (2) constitutes, during the assembly, a sub-assembly (100) adapted to come and clip itself in the cover (16) to be retained therein, in a manner so as to constitute an assembly (160) adapted to be introduced into the container (3) before crimping, as is shown in FIG. 15. The clipping ensuring the holding of the device (1) in the cover (16) before the positioning of the assembly (160) is obtained due to the slight flange (161) provided at the periphery of the cover. It is also noted that a mechanism is provided for indexing the relative angular position of the cover (16) with the device (1) of the invention making it possible to position the device (1) in a good angular position with respect to the cover (16), so that the straw, once it is released, projects and appears at the level of the hold made by the precut tongue (7).

Of course, the invention is not limited to the embodiments described and shown by way of examples, but it also includes all the technical equivalents as well as their combinations.

What is claimed is:

1. A device for automatically extracting a straw arranged in an interior of a container provided with an opening mechanism, comprising:

a straw-supporting element movable between a free position in which a straw which it supports has its end in an orifice of the opening mechanism of the container and a locked position in which said end is arranged in the interior of the container, said straw-supporting element comprising an arm bearing at its end a mechanism for retaining the straw and being furthermore articulated on an intermediate piece, whereas the intermediate piece has a peripheral edge portion adapted to be arranged between an upper wall and a peripheral wall of the container in order to be gripped therein by crimping.

2. The device according to claim 1, further comprising a mechanism for biasing the straw-supporting element from its locked position to its free position.

3. The device according to claim 2, further comprising a mechanism for locking the straw-supporting element in its locked position.

4. The device according to claim 2, further comprising a device for unlocking the supporting element from its locked position.

5. The device according to claim 4, wherein the unlocking device comprises a secondary unlocking arm.

6. The device according to claim 1, wherein the intermediate piece and the supporting arm are obtained all in one piece, forming a single and same plastic piece that has a certain elasticity.

7. The device according to claim 1, wherein the intermediate piece is in the form of an annular ring.

8. A device for automatically extracting a straw from a container, comprising:

a straw-supporting element movable between a free position and a locked position;

said straw-supporting element comprising an arm bearing at its end a mechanism for retaining a straw and being articulated on an intermediate piece, said intermediate piece having a peripheral edge portion adapted to be arranged between an upper wall and a peripheral wall of the container in order to be gripped therein by crimping.

9. The device according to claim 8, further comprising a mechanism for biasing the straw-supporting element from its locked position to its free position.

10. The device according to claim 9, further comprising a mechanism for locking the straw-supporting element in its locked position.

11. The device according to claim 9, further comprising a device for unlocking the supporting element from its locked position.

12. The device according to claim 11, wherein the unlocking device comprises a secondary unlocking arm.

13. The device according to claim 8, wherein the intermediate piece and the supporting arm comprise a single plastic piece that has a certain elasticity.

14. The device according to claim 8, wherein the intermediate piece is in the form of an annular ring.

15. A device for automatically extracting a straw from a container, comprising:

a straw-supporting element movable between a free position and a locked position;

said straw-supporting element comprising an arm bearing at its end a mechanism for retaining a straw and being articulated on an intermediate piece, said intermediate piece having a peripheral edge portion adapted to be arranged between an upper wall and a peripheral wall of the container in order to be gripped therein by crimping;

a mechanism for biasing the straw-supporting element from its locked position to its free position;

a mechanism for locking the straw-supporting element in its locked position; and a device for unlocking the supporting element from its locked position.

16. In combination, a container having an interior, a device for opening said container, the device for opening having an orifice, a straw arranged in the interior of said container, said straw having a first end, and a device for automatically extracting said straw from the interior of said container, said device for automatically extracting comprising:

a straw-supporting element movable between a free position in which the straw first end is in said orifice and a locked position in which said first end is arranged in the interior of the container, said straw-supporting element comprising an arm bearing at its end a mechanism for retaining the straw and being furthermore articulated on an intermediate piece, wherein the intermediate piece has a peripheral edge portion adapted to be arranged between an upper wall and a peripheral wall of the container in order to be gripped therein by crimping.

17. The combination of claim 16, further comprising a mechanism for biasing the straw-supporting element from its locked position to its free position.

18. The combination of claim 17, further comprising a mechanism for locking the straw-supporting element in its locked position.

19. The combination of claim 18, further comprising a device for unlocking the supporting element from its locked position.

20. The combination of claim 19, wherein the unlocking device comprises a secondary unlocking arm.

21. The combination of claim 16, wherein the intermediate piece and the supporting arm comprise a single plastic element having a certain elasticity.

22. The combination of claim 16, wherein the intermediate piece is in the form of an annular ring.

23. A method of automatically extracting a straw from an interior of a container having an interior and including a device for opening said container, the device for opening having an orifice, a straw arranged in the interior of said container, said straw having a first end, and a device for automatically extracting said straw from the interior of said container, the method comprising:

moving a straw-supporting element between a free position in which a first end of the straw is in said orifice and a locked position in which said first end is arranged in the interior of the container, said straw-supporting element comprising an arm bearing at its end a mechanism for retaining the straw and being furthermore articulated on an intermediate piece; and crimping a peripheral edge portion of the intermediate piece between an upper wall and a peripheral wall of the container in order to be gripped therein.

24. The method of claim 23, further comprising biasing the straw-supporting element from its locked position to its free position.

25. The method of claim 24, further comprising locking the straw-supporting element in its locked position.

26. The method of claim 25, further comprising unlocking the supporting element from its locked position.

27. The device according to claim 1, wherein said container comprises a can.

28. The device according to claim 27, wherein said can comprises a cylindrical can.

29. The device according to claim 8, wherein said container comprises a cylindrical can.

30. The device according to claim 18, wherein said container comprises a cylindrical can.

31. The combination according to claim 16, wherein said container comprises a cylindrical can.

* * * * *